United States Patent [19]

Okerstrum

[11] 4,121,731

[45] Oct. 24, 1978

[54] TOP ENCLOSURE FOR CHILDREN'S DRINKING VESSELS

[76] Inventor: Scott Okerstrum, 379 Hampton Rd., Hoffman Estates, Ill. 60195

[21] Appl. No.: 799,394

[22] Filed: May 23, 1977

[51] Int. Cl.[2] ..... A47G 19/22

[52] U.S. Cl. ..... 220/90.4; 222/509; 222/517

[58] Field of Search ..... 220/90.2, 90.4; 222/508, 509, 517, 518

[56] References Cited

U.S. PATENT DOCUMENTS

| | | | |
|---|---|---|---|
| D. 233,972 | 12/1974 | Juhlin | 220/90.4 |
| 3,272,391 | 9/1966 | Meshberg | 222/509 |
| 3,272,392 | 9/1966 | Meshberg | 222/509 |
| 3,323,690 | 6/1967 | Monahon | 222/509 |
| 3,542,257 | 11/1970 | Parish | 222/509 |
| 3,964,631 | 6/1976 | Albert | 220/90.4 |
| 3,967,748 | 7/1976 | Albert | 220/90.4 |
| 3,972,443 | 8/1976 | Albert | 220/90.4 |
| 4,033,487 | 7/1977 | Micallef | 222/509 |

*Primary Examiner*—Ro E. Hart

*Attorney, Agent, or Firm*—Donnie Rudd; Marshall N. Dickler

[57] ABSTRACT

A top enclosure for drinking vessels is disclosed. The enclosure enables young children to drink from the drinking vessel only when handles on opposing sides of the vessel are depressed. If only one handle is depressed, such as if the vessel drops on the floor and rolls over on one handle, then the top enclosure remains closed and fluids cannot run out of the vessel.

3 Claims, 7 Drawing Figures

TOP ENCLOSURE FOR CHILDREN'S DRINKING VESSELS

BACKGROUND OF THE INVENTION

1. Field of the Invention

This invention relates to a top enclosure for drinking vessels for use by small children.

2. Description of the Prior Art

Many different types of drinking vessels have been developed for use by small children. One of the primary objects for such small vessels is that it have an opening in the top thereof that permits only restricted flow from the vessel to the mouth of the small child. This prevents the small child from dumping the contents of the vessel onto himself when drinking from the vessel. While these types of devices have been very useful in enabling small children to drink from cups without spilling the contents on themselves, they, nevertheless, have one deficiency that has presented a problem with respect to such devices. If the small child tips the container over, the fluids in the container will immediately spill on the floor or someplace else and drain from the container. The only solution previously found for overcoming this problem is to weight the bottom of the container down so that it always stands in an upright position. This weighting, however, must counter balance the weight of the fluid in the container and when the weight of the counter-balance is added to the weight of the fluid in the vessel, it becomes so heavy that it is difficult for the child to manage any sizeable quantity of fluid in the vessel. The new and novel invention presented herein overcomes this problem and does not require any type of counter-balancing on the bottom of the container. Consequently, all of the problems in the prior art designs are overcome by the new and novel invention presented herein.

SUMMARY OF THE INVENTION

It is an object of this invention to provide a top enclosure for drinking devices, such as cups or glasses or the like, for use by small children.

It is the further object of this invention to provide a drinking vessel that enables small children to drink therefrom and which presents a minimum exposure to the contents of the vessel being spilled by the small child.

The objects of this invention are accomplished by a closure for the tops of the drinking devices which small children use. The top enclosure can be either a separate product which can be placed onto a cup or glass sealing the top thereof, or it can be an integral part of the container itself. The top enclosure has handles depending from opposing sides thereof, which fit about the outside of the container. The handles can be grip type handles or they may simply be flat surfaces which conform to the contour of the outside of the container. In any of the contemplated designs, the handles will have some method of causing them to return outward when the handle is not being gripped and, this may be accomplished either by a spring type extension of the end of the handle or by springs or other types of designs which force the handle outward when not in use. The heart of this design contemplates a feature which requires that both handles be depressed at the same time in order to cause the opening of the top of the vessel.

In one prefered embodiment of this invention, the handles terminate on the interior ends thereof by extensions thereon which extensions terminate by or in parallel planes such that the depression of both handles causes one of the handle extensions to slide upon the other and deform out of its normal plane. When one of the handle extensions deforms out of its normal plane, it depresses upon a lever or some other such means which is connected to a closure which seals the opening. The depressin of the lever thereby causes the closure on the opening to open up and allows the child to drink from the vessel.

BRIEF DESCRIPTION OF THE DRAWINGS

This invention may be more fully described, but is not limited by the attached drawings wherein.

DESCRIPTION OF THE PREFERRED EMBODIMENTS

Figure 1:
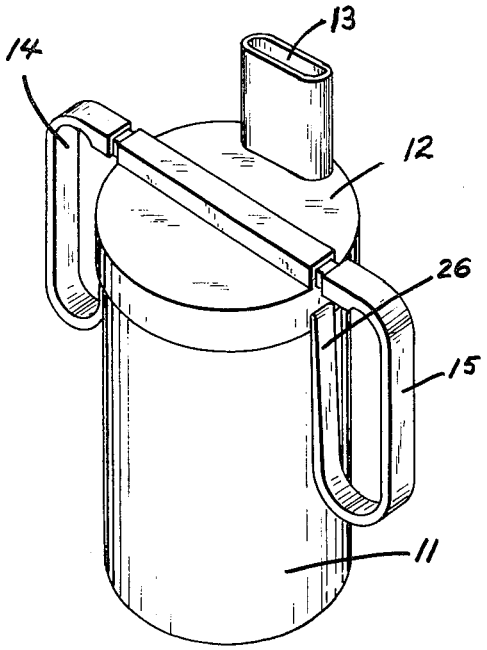
FIG. 1 is a perspective view of the drinking cup made possible by this invention.
Figure 2:
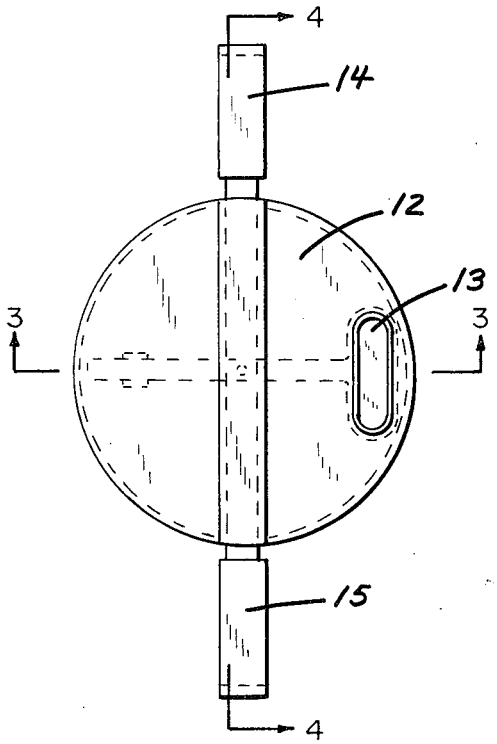
FIG. 2 is a top view of the drinking cup in FIG. 1.
Figure 3:
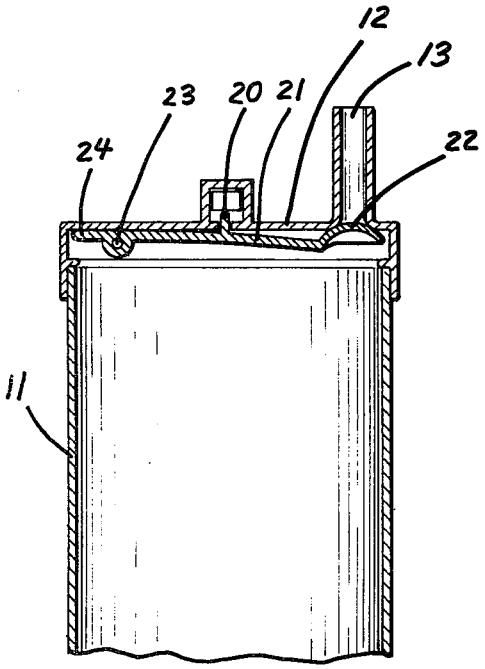
FIG. 3 is a cross-sectional view taken along the line 3—3 of FIG. 2.
Figure 4:
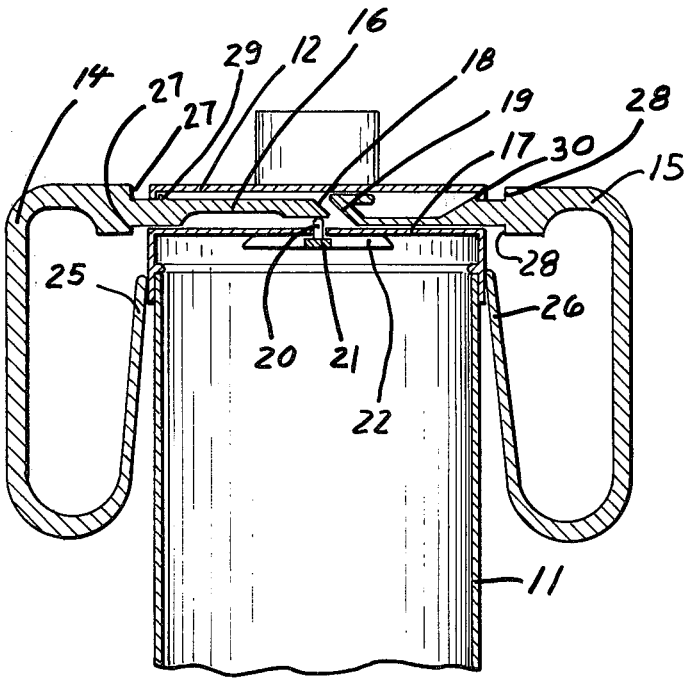
FIG. 4 is a cross-sectional view taken along the line 4—4 of FIG. 2.
Figure 5:
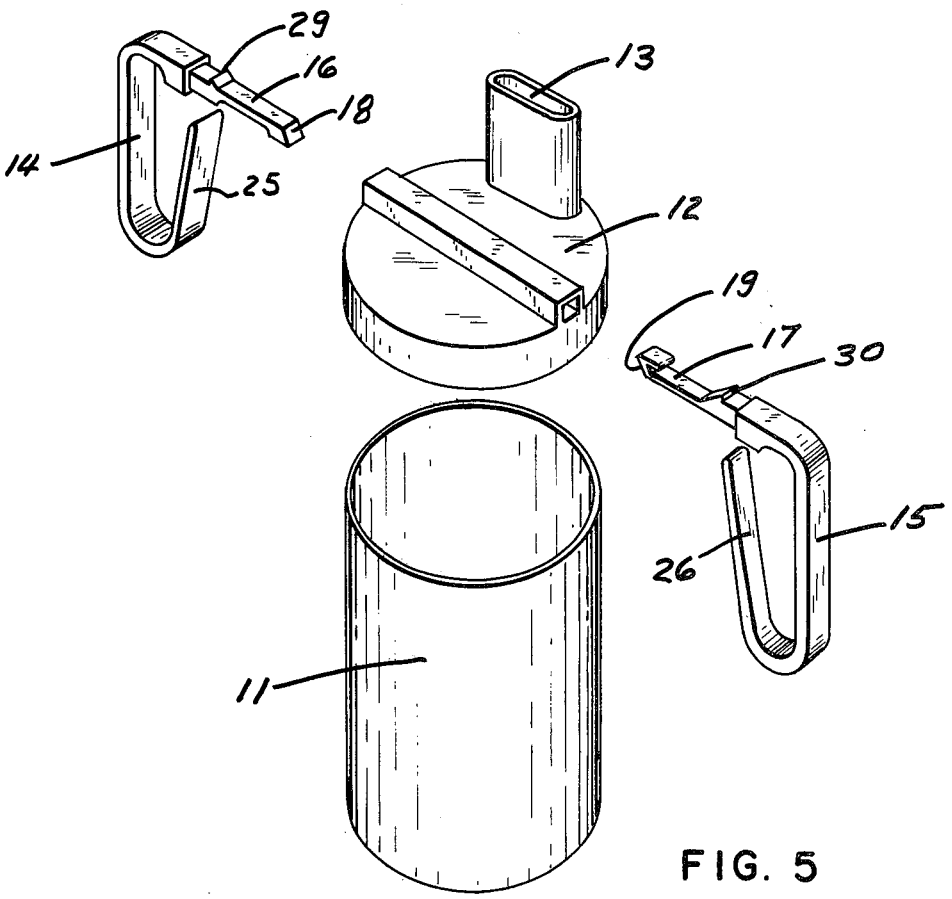
FIG. 5 is an exploded perspective view of a preferred embodiment of this invention.
Figure 6:
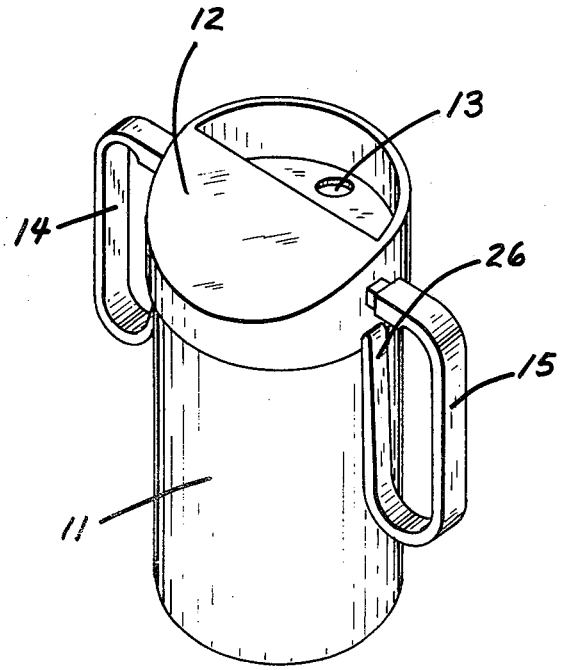
FIG. 6 is a perspective view of a drinking cup according to this invention but having a different top opening.
Figure 7:
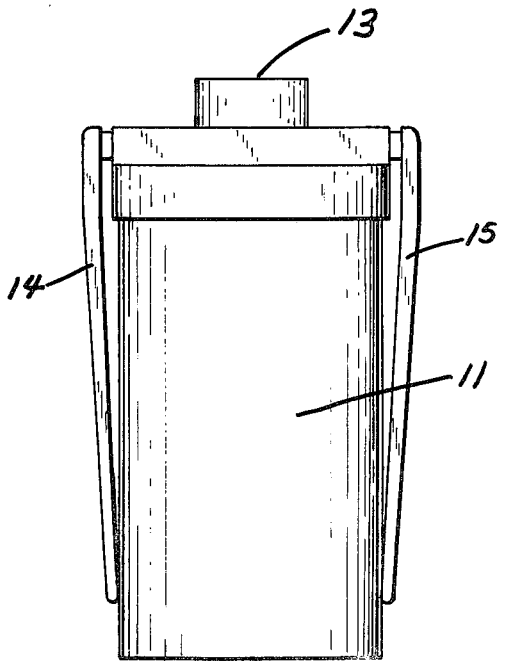
FIG. 7 is a side view of still another embodiment of the drinking cup of this invention.

This invention may be more fully described, but is not limited by the attached drawings, wherein a drinking cup 11 has a top closure 12 with an opening 13 for fluids to escape out of the vessel. The top enclosure has opposing downward depending handles 14 and 15 which must each be depressed in order for fluids to flow out of the vessel. In the preferred embodiment shown in FIGS. 1–7, the enclosure is separate from the cup and may be detached therefrom for cleaning. However, it must be understood that the enclosure may be made an integral part of the cup. In the preferred embodiment shown in the drawings, the handles terminate on their upper surfaces by handle extensions 16 and 17 which, in turn, terminate in parallel slanted plane surfaces 18 and 19. When the handles 14 and 15 are both depressed, the plane surfaces 18 and 19 meet and handle extension arm 16 is depressed out of its normal plane. The handle extension 16 then depresses 10–20 which depresses lever 21 forcing closure 22 away from the opening bottom 13. This allows fluid to leave the vessel. The lever 21 has some suitable spring method such as 10–23 and lever arm 24 which forces the end closure of the lever constantly into the hole seating thereon unless forced otherwise. The handles must return to their undepressed state when not in use and this can be by any suitable spring device but may be as shown, wherein, handle extensions 25 and 26 force the handles outward when not being depressed. The handles then can be prevented from being depressed too far by stops 27 and 28 and can be stopped from being pulled out of their opening by stops 29 and 30. When only one of the handles is depressed, the end of the lever will move over as far as it is allowed to move and will not depress the lever and open the container. This is true regardless of which of the handles are independently pressed downward. However, when both handles are depressed downward, one of the handle ends will deform from its normal plane and will thereby force the closure open and allow the participant or child to drink.

It may be thus be seen that this invention provides the first truly acceptable system for allowing small children to drink from vessels which overcomes the need for heavy counter-balances to right the vessel and which prevents the vessel from spilling its contents when the child dumps it upon the floor. There has been a long-felt need for such a device and this is the first such device which overcomes all of the problems associated with prior known devices.

Having fully described this new and unique invention, the following is claimed:

1. A drinking cup for children, said cup comprising a drinking vessel with a top opening, and said cup having handles on opposing sides thereof, said handles having means for opening the cup attached thereto, said means for opening requiring depression of both of the opposing handles in order to allow fluids to leave the cup.

2. A top enclosure for drinking vessels used by children, said top enclosure comprising a body portion with an opening therein, said body portion having a vessel engaging portion for engaging and sealing it about the top of a vessel, a closure for the opening in the body portion, handles depending from opposing sides of the body portion, and means for opening the closure when both and only both of the handles are depressed.

3. A top enclosure as in claim 2 wherein the means for opening the closure comprises handle extensions terminating in parallel slanted planes, and means for transmitting distortion of the handle extensions to the closure to cause it to open.

* * * * *